United States Patent [19]

Aoki et al.

[11] Patent Number: 4,926,017

[45] Date of Patent: May 15, 1990

[54] VACUUM BREAKER

[75] Inventors: Shinichi Aoki; Eizo Naya, both of Amagasaki, Japan

[73] Assignee: Mitsubishi Denki Kabushiki Kaisha, Tokyo, Japan

[21] Appl. No.: 172,490

[22] Filed: Mar. 24, 1988

[30] Foreign Application Priority Data

Mar. 24, 1987 [JP] Japan ..... 62-69480
May 29, 1987 [JP] Japan ..... 62-136672

[51] Int. Cl.[5] ..... H01H 33/66
[52] U.S. Cl. ..... 200/144 B
[58] Field of Search ..... 200/144 B

[56] References Cited

U.S. PATENT DOCUMENTS

| | | | |
|---|---|---|---|
| 4,077,114 | 3/1978 | Sakuma | 200/144 B |
| 4,079,217 | 3/1978 | Oeschger | 200/144 B |
| 4,225,763 | 9/1980 | Barkan | 200/144 B |
| 4,394,554 | 7/1983 | Warabi et al. | 200/144 B |
| 4,695,687 | 9/1987 | Grosse et al. | 200/144 B |

FOREIGN PATENT DOCUMENTS

| | | |
|---|---|---|
| 0138257 | 4/1985 | European Pat. Off. . |
| 1815722 | 9/1969 | Fed. Rep. of Germany . |
| 3535066 | 2/1986 | Fed. Rep. of Germany . |
| 8499 | 4/1975 | Japan . |
| 56323 | 4/1985 | Japan . |
| 28358 | 8/1986 | Japan . |

*Primary Examiner*—Robert S. Macon
*Attorney, Agent, or Firm*—Fleit, Jacobson, Cohn, Price, Holman & Stern

[57] ABSTRACT

A pair of electrodes connected to conductors through joining means respectively are arranged in a vacuum switch tube such that current passes when they come into contact, and does not pass when they separate. At least part of the electrodes, the conductors or the joining means is made of materials with vibration absorbing properties.

18 Claims, 10 Drawing Sheets

VACUUM BREAKER

BACKGROUND OF THE INVENTION

This invention concerns vacuum breakers, and more particularly the improvement of stationary and moving electrodes of vacuum breakers.

Vacuum breakers are disclosed for example in Japanese Patent Publication No. 8499/1975 and Japanese Patent Laid-Open No. 56323/1985. FIG. 11 is a profile section showing the structure of a conventional electromagnetic driving vacuum breaker as described in Patent Publication No. 8499/1975. In this figure, 101 is a vacuum switch tube. It comprises a container under vacuum consisting of an insulator housing 7, a fixed end plate 6*a* and moving end plate 6*b*, and bellows 3. The rod-shaped stationary conductor 2*a* traverses the fixed end plate 6*a*, its joints being of such a construction as to maintain the vacuum inside the container. The moving conductor 2*b* opposite stationary conductor 2*a* traverses bellows cover 4 fitted to the end of bellows 3, the joint between moving conductor 2*a* and bellows cover 4 also being so constructed as to maintain the internal vacuum. At the ends of stationary conductor 2*a* and moving conductor 2*b* which are facing each other, a stationary electrode 1*a* and moving electrode 1*b* are installed. The other end of stationary conductor 2*a* is secured to a fixed terminal 102. The moving conductor 2*b* is driven in direction A by a control mechanism 103 via a hinge 104. The moving shunt 105 is a flexible conductor, one end being connected to moving conductor 2*b* and the other end to fixed terminal 106.

In the above vacuum breaker, current flows via fixed terminal 106, moving shunt 105, moving conductor 2*b*, moving electrode 1*b*, fixed electrode 1*a*, fixed conductor 2*a* and fixed terminal 102.

We shall explain the closing action of the vacuum breaker with reference to FIGS. 10A, B and C. FIG. 10A shows the stroke characteristic of moving conductor 2*b*. At time $t_0$, the control mechanism 103 begins operating, and exerts a force which pushes the moving conductor 2*b* toward the upper part of FIG. 11. As the bellows 3 are free to extend and contract, moving conductor 2*b* moves upwards. At time $t_2$, stationary electrode 1*a* and moving electrode 1*b* come into contact. After these electrodes have chattered several times (3 times in FIG. 12A), they touch each other finally. FIG. 12B shows the closing action of the electrodes set up by this chattering. Chattering occurs, moreover, whether the switch has an electrical load or not. The chattering frequency and the total chattering period vary depending on the roughness of the electrodes, and the speed of motion of moving electrode 2*b* driven by control mechanism 103.

In general, at the time of closing, a making current produces an electromagnetic repulsion between the electrodes so that the electrodes remain apart longer during chattering. Also, in case of closing high voltages, a pre-arc is set up at a time $t_1$ before the time $t_2$ at which metal contact actually occurs when the distance 1 between the electrodes is less than a specified value. As shown in FIG. 12C, therefore, when the breaker is closed for passing making current under a high voltage, there is a pre-arc time P, and arcing times $T_1$, $T_2$, $T_3$ when the electrodes are opened due to chattering. Melting due to the heat of the arc and generation of heat due to metal contact are repeated several times during closing action. The sum of the shaded areas in FIG. 12C (arcing times) (current x time) is related to the heat of the arc produced, and the arc heat accounts for most of the energy input to the electrodes. As arc heat increases, electrode melting and wear become very obvious, and the temperature rises. At the same time there is increased deposition on the electrodes. This deposition sometimes makes it impossible to separate the electrodes. This kind of serious trouble is often mainly due to excessive arc heat.

The main performance characteristics of vacuum breakers, namely breaking performance, deposition property, wear resistance, breakdown voltage and current chopping performance depend largely on the material of the electrodes. In general, however, these characteristics are contradictory to each other. For example, electrode materials which are excellent for breaking give unsatisfactory deposition property. In conventional vacuum breakers, materials with excellent circuit breaking properties were used even though their use did result in poorer deposition performance. To prevent accidents due to deposition, however, it was necessary to supply high energies to control mechanism 103 so as to increase the external pressure on the electrodes and increase the force pulling them apart. As a result, the control meachanism not only had to be bulky and costly, but the life of the bellows and fixed end plate was shortened due to mechanical fatigue under the increased external pressure. Various means were devised in an attempt to overcome these disadvantages. In the device shown in FIG. 11, the direction of the current flowing in shunt 105 is reversed in the V-shaped section, and the electromagnetic repulsion produced in this section was used to apply an upward pressure to moving conductor 2*b*.

As shunt 105 is installed at some distance away from conductor 2*b*, however, some time delay is required for the applied pressure to be transmitted to the conductor. This device was therefore not necessarily effective in preventing chattering or preventing the electrode from floating up. Various designs for terminal 102 were attempted in order to restrict chattering, but as the chattering depends on the roughness of the electrodes, it was found to be extremely difficult to suppress it to a stable level throughout the entire life of the breaker.

SUMMARY OF THE INVENTION

This invention aims to overcome the above disadvantages by providing a compact, low-price control mechanism wherein the electrodes require little force to be separated with a corresponding reduction of energy input, thus suppressing chattering with stability throughout the entire life of the vacuum breaker. Another object of this invention is to provide a vacuum breaker wherein the electrodes have little roughness and wear. The third object of this invention is to provide a vacuum breaker which offers reliable performance with regard to deposition accidents or mechanical fatigue.

According to the invention, there is provided a vacuum breaker comprising a switch tube maintained under vacuum, a first electrode arranged in said switch tube, a first conductor connected to said first electrode through a first joining means, a second electrode arranged in said switch tube such that it can come into contact with the first electrode and separate from it, and a second conductor connected to said second electrode through a second joining means, wherein at least part of one among the first and second electrodes, the first and second conductors, and the first and second joining means, is made of material with vibration absorbing properties.

According to this invention, chattering is considerably reduced at the time of closing electrodes. At the same time, deposition forces are much lower when the breaker is closed, so it can be controlled by a compact, economical mechanism which provides a small force to break any deposition. Further, the bellows and fixed end plate have a longer mechanical fatigue life, and a vacuum breaker of high reliability can therefore be obtained.

DETAILED DESCRIPTION OF THE PREFERRED EMBODIMENT

Figure 1:
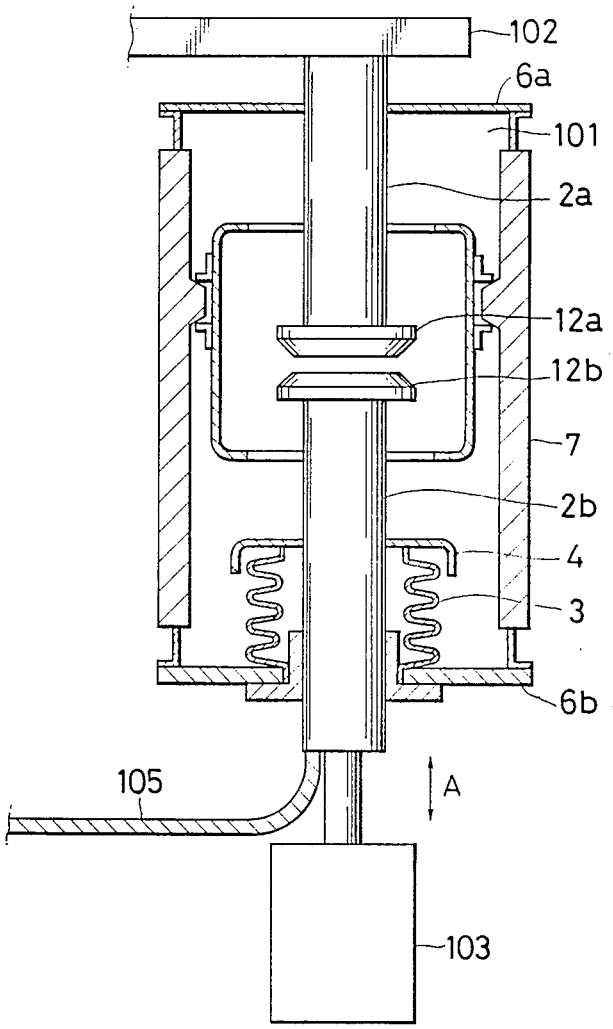
FIG. 1 is a section in profile showing the structure of vacuum breakers common to all the embodiments of this invention.

FIG. 1 is a section in profile showing the common structure of the vacuum breakers in the embodiments of this invention. The vacuum switch tube 101 comprises an insulator housing 7, fixed end plate 6a, moving end plate 6b, bellows 3 and bellows cover 4, and the inside of the tube is maintained under vacuum. The stationary conductor 2a is inserted into the vacuum switch tube 101 through the fixed end plate 6a, the joint between the fixed end plate 6a and stationary conductor 2a being of such a construction as to maintain the interior airtight. In the drawing, the upper end of the stationary conductor 2a is connected to a fixed terminal 102 and the lower end is provided with a stationary electrode 12a. The moving conductor 2b, on the other hand, is inserted into vacuum switch tube 101 through bellows cover 4. As in the conventional structure, the joint between bellows cover 4 and moving conductor 2b is constructed so as to maintain the airtightness of the interior. A moving electrode 12b is fitted to the upper end of moving conductor 2b, the lower end being connected to control mechanism 103 which drives conductor 2b in direction A.

Figure 2:
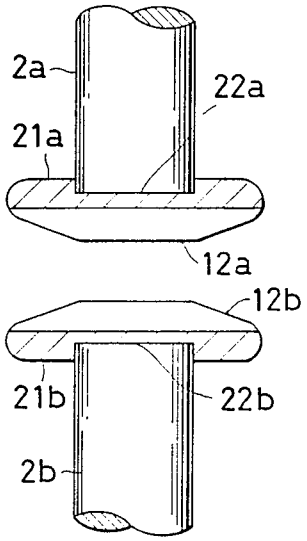
FIG. 2 is a section in profile showing the electrodes and conductors of the vacuum breaker in the first embodiment of this invention.

FIG. 2 illustrates the first embodiment of this invention. In this embodiment, a part 21a of stationary electrode 12a and a part 21b of moving electrode 12b are constructed of a material with vibration absorbing properties. Similarly, the solder joints 22a and 22b which connect stationary electrode 12a with stationary conductor 2a, and moving electrode 12b with moving conductor 2b respectively, consist of a material with vibration absorbing properties. As the electrodes, conductors and joining solder must be electrically conducting, the materials of their construction should have an electrical conductivity no less than 10% that of copper. If the conductivity is less than this value, the heat evolved when current is passed will no longer be negligible, and it will be difficult to use the structure in practice.

These materials should moreover not impair the joining properties or electrical conduction properties of the electrodes and conductors. At the same time, it is preferable that their particle size does not exceed 10 μm; if the particle size is greater, mechanical strength falls, and the materials may be damaged when the electrodes impact.

It is also preferable that the melting point of the solder 22a and 22b is less than 1000° C. If it is higher, higher temperatures are necessary to join the component elements of the assembly, resulting in larger crystals and possible decline of mechanical strength.

Materials which satisfy the above criteria include copper-manganese, copper-manganese-aluminum, copper-aluminum-nickel and nickel-titanium alloys.

Figure 3B:
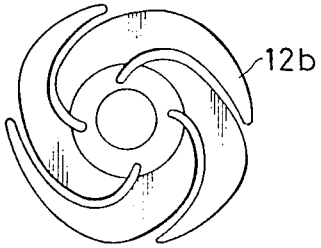
FIG. 3B is a plan view of the electrodes in the second embodiment.
Figure 3A:
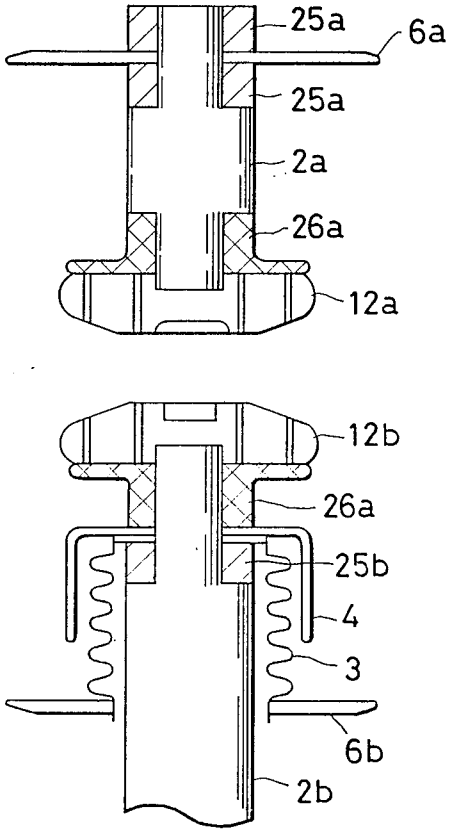
FIG. 3A is a section in profile showing the electrodes, conductors, bellows and fixed end plate in the second embodiment of this invention.

FIGS. 3A and B illustrate the second embodiment of the invention. In this emdodiment stationary conductor 2a is connected to fixed end plate 6a via a joining piece 25a with similar electrical conduction and vibration absorbing properties to the above case. Further, moving electrode 2b is connected to bellows 3 via a joining piece 25b with similar properties.

In this embodiment, electrodes 12a and 12b are in the form of a spiral. It is known that the spiral electrodes are efficient in preventing them from being heated locally by arcs because the arcs are driven by magnetic effect in the radial direction along the fins. On the back side of the electrodes and arranged around their circumference, there are other parts 26a and 26b which consist of high resistance materials with vibration absorbing properties. This arrangement of high resistance materials on the backs of the electrodes has the effect of concentrating the passage of the current in the cores of the conductors 2a and 2b. The magnetic drive effect of the arc is therefore increased, and breaking properties are improved. As parts 26a and 26b should have high resistance, they are constructed of materials with an electrical conductivity less than 10% that of copper. Typical examples of such materials are iron-chromium-aluminum, iron-chromium-molybdenum or iron-carbon-silicon alloys.

Figure 8A:
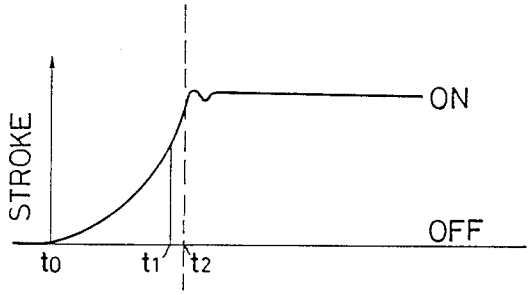
FIG. 8A is a graph showing the stroke characteristics of the moving electrode of the first embodiment.
Figure 8B:
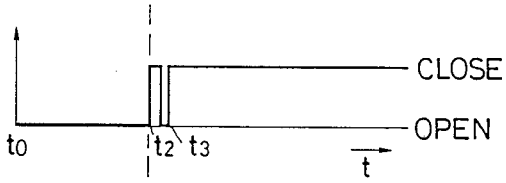
FIG. 8B is a time chart showing the chattering of the moving electrode of the first embodiment.
Figure 8C:
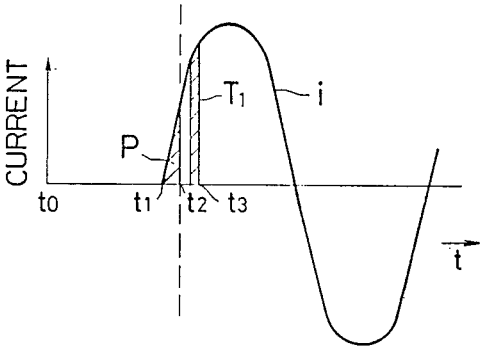
FIG. 8C is a waveform diagram showing the fluctuations of current due to the chattering of the first embodiment.

FIGS. 8A, B and C describe the action of a vacuum breaker with the construction shown in FIG. 2. The closing action is almost exactly the same as in the case of a conventional breaker. When the two electrodes impact at time $t_2$ in FIG. 8A, however, the vibration absorbing alloys constituting part of the electrodes or conductors absorb the energy of impact, which is dissipated as heat, and chattering is therefore suppressed. In a vacuum breaker with a rating of 12 KV-25 KA based on the first embodiment, therefore, it was confirmed experimentally not only that the 2nd electrode separation time $T_2$ (and subsequent separation times) due to chattering were absent, but also that the time $T_1$ can be shortened in comparison to the conventional case. For example, the time $T_1$ was originally 0.5 ms or more, whereas it is suppressed to 0.3 ms or less in the first embodiment.

As a result, the arc heat due to chattering when a making current is passed through the breaker, is far less than in the conventional case. It was confirmed that melting, wear and surface roughness of the electrodes do not occur easily, and that deposition forces can be greatly reduced. Typically, electrodes which exhibited a deposition force of at least 100 Kg will show a force of 50 Kg or less in the construction of FIG. 2.

In the embodiment of FIG. 2, part of the electrodes and the solder joining the electrodes and conductors consists of pieces of electrically conducting, vibration absorbing material. However, when at least electrode or solder is made of vibration absorbing materials, it is able to reduce chattering.

As shown in FIGS. 3A and B, moreover, if stationary conductor 2a is secured to fixed end plate 6a by sandwiching the end plate 6a with the joining pieces 25a, and if moving conductor 2b is secured to bellows 3 by sandwiching the bellows cover 4 with the joining piece 25b and part 26b, chattering is suppressed as in the previous case. At the same time, it was confirmed that the mechanical shock waves set up in conductors 2a and 2b are less easily transmitted to bellows 3 and fixed end plate 6a. As a result, the life of the bellows in extension and contraction is remarkably improved, as is the mechanical fatigue breaking lifetime of the joining piece on fixed end plate 6a. In the second embodiment therefore, it was found that a conventional mechanical lifetime of 30,000–50,000 actions was lengthened to 100,000–250,000 actions.

Figure 4:
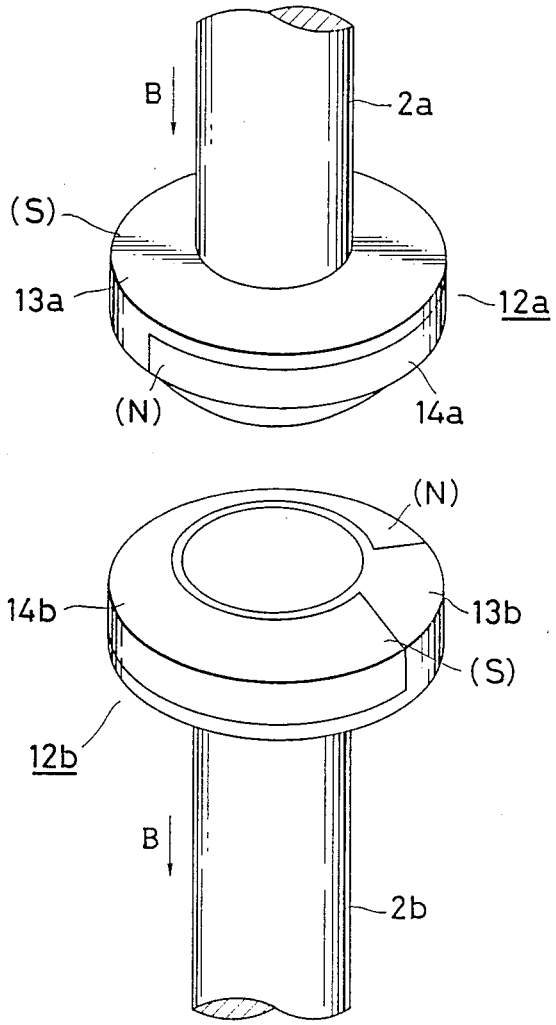
FIG. 4 is a perspective view showing the structure of the fixed electrode and moving electrode in the third embodiment of this invention.
Figure 5:
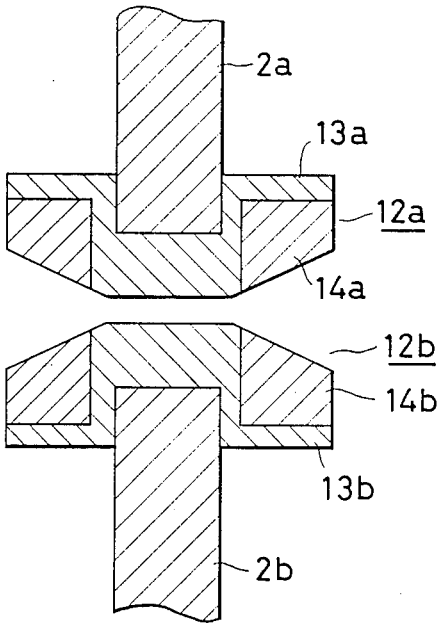
FIG. 5 is a view in section of the fixed and moving electrodes shown in FIG. 4.

FIGS. 4 and 5 show the structure of stationary electrode 12a and moving electrode 12b in the third embodiment. Stationary electrode 12a has a contact piece 13a which is joined to the end of stationary conductor 2a. A magnetic piece 14a, consisting of a magnetic, vibration absorbing alloy formed in to a shape of a letter "C" wrapped around the center of stationary electrode 12a, is inlaid in contact piece 13a to which it is attached by soldering or other means. This magnetic material may for example be iron-chromium, iron-aluminum, iron-chromium-aluminum or iron-carbon-silicon alloy. From these materials, magnetic parts with satisfactory vibration absorption properties can be manufactured. In moving electrode 12b, a magnetic piece of vibration absorbing alloy 14b is inlaid in a contact piece 13b in a similar way to stationary electrode 12a. The open part of the "C" shape of piece 14b is oriented at 180 with respect to the open part of piece 14a.

We shall now explain the action of the third embodiment. In FIG. 1, control mechanism 103 first operates so as to drive moving conductor 2b toward the fixed conductor 2a. When the distance between stationary electrode 12a and moving electrode 12b is less than a certain limit, a pre-arc is set up between stationary conductor 2a and moving conductor 2b. This causes magnetic pieces 14a and 14b in FIG. 4 to become magnetized. When the current is flowing in direction B, for example, the two ends of pieces 14a and 14b become N and S poles as shown in the figure. As pieces 14a and 14b have a letter "C" shape, these N and S poles are confronting or aligned with each other vertically. The result is that magnetic pieces 14a and 14b mutually attract each other, so that moving electrode 12b are pulled closer to stationary electrode 12a.

When the tips of the two electrodes touch, the current increases, and so the force of attraction between pieces 14a and 14b also increases. The parts of the electrodes in contact (contact pieces) are made of a material with good electrical conduction properties such as copper, silver or aluminum. Due to elasticity, moving electrode 12b which came into contact with stationary electrode 12a would tend to set up chattering. The attraction between the two magnets however keeps the electrodes in contact and prevents them from separating so that chattering does not occur. Further, magnetic pieces 14a and 14b are constructed from a vibration absorbing material. As a result, the vibration which is set up when moving electrode 12b first impacts stationary electrode 12a is absorbed by pieces 14a and 14b, and the vibration of moving electrode 12b is rapidly attenuated.

In a case where the construction of the third embodiment was applied to a vacuum breaker with a rating of 12 KV-25 KA, the force of magnetic attraction due to the magnetic pieces attached to the stationary and moving electrodes was approx. 50 Kg, and it was thus possible to reduce the pressure applied by control mechanism 103 from 120 Kg to approx. 70 kg.

Figure 6:
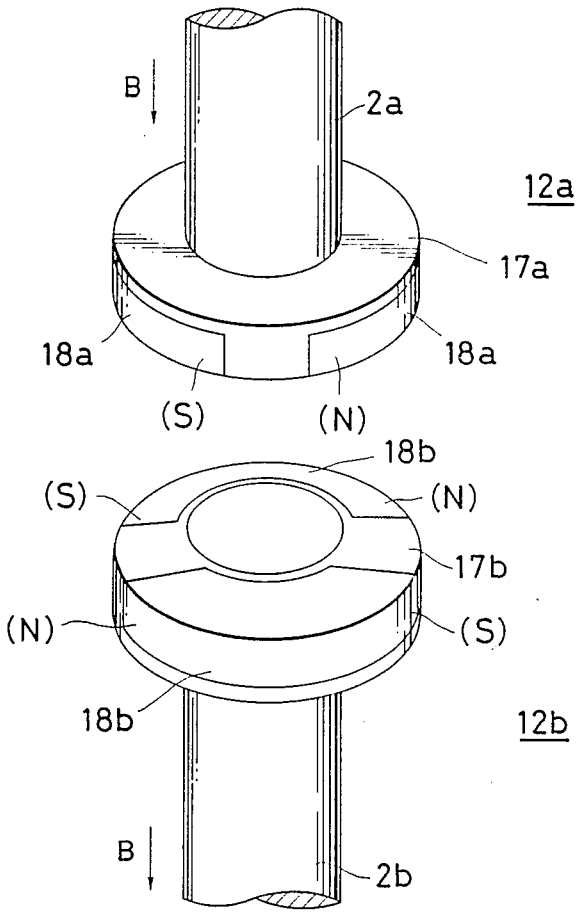
FIG. 6 is a perspective view showing the structure of the stationary and moving electrodes in the fourth embodiment of this invention.
Figure 7:
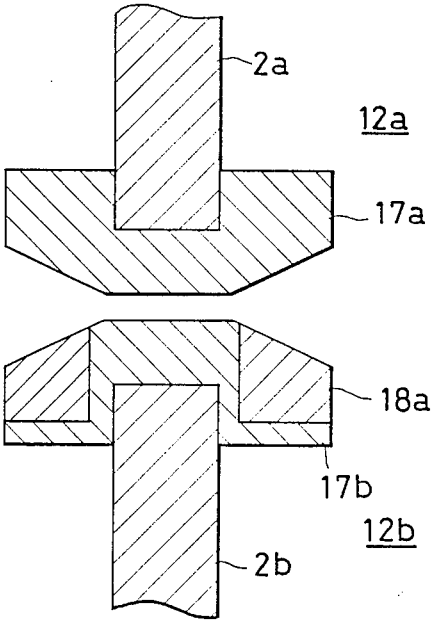
FIG. 7 is a view in section of the stationary and moving electrodes shown in FIG. 6.

FIGS. 6 and 7 show the structure of the stationary and moving electrodes in the fourth embodiment of this invention. In this embodiment, two magnetic pieces in the form of an arc, 18a and 18b, are inlaid in contact pieces 17a and 17b of stationary electrode 12a and moving electrode 12b respectively. Magnetic piece 18b of moving electrode 12b is oriented at 90° with respect to magnetic piece 18a of stationaly electrode 12a. In this embodiment too, as shown in FIG. 6, when current flows in the direction B, magnetic pieces 18a and 18b become magnets, and a force of attraction is set up in the same way as in the third embodiment.

The force of attraction in the fourth embodiment is less than in the third embodiment, but as the attraction is well-balanced in a radial direction, the applied pressure effect obtained on moving electrode 12b is even more effective.

In the third and fourth embodiments, a magnetic attraction due to a pre-arc is thus set up between the stationary electrode and moving electrode when the vacuum breaker is closed. This shortens the closing time of the electrodes. Further, as the magnetic pieces attached to the electrodes are made of a vibration absorbing alloy, the impact wave produced when they come in contact is absorbed so that electrode chattering is prevented. The applied pressure that has to be furnised by the control mechanism to drive the moving electrode can thus be greatly reduced, resulting in a more compact, lower cost mechanism.

Figure 9:
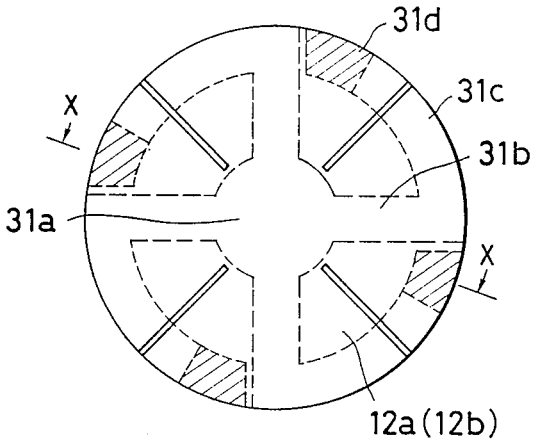
FIG. 9 is a plan view of an electrode of the fifth embodiment.
Figure 10:
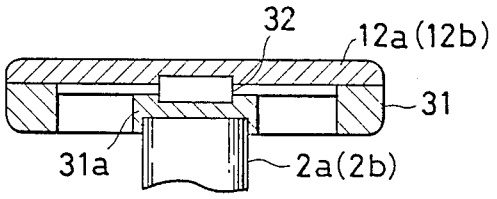
FIG. 10 is a view in section along line x—x of FIG. 9.
Figure 11:
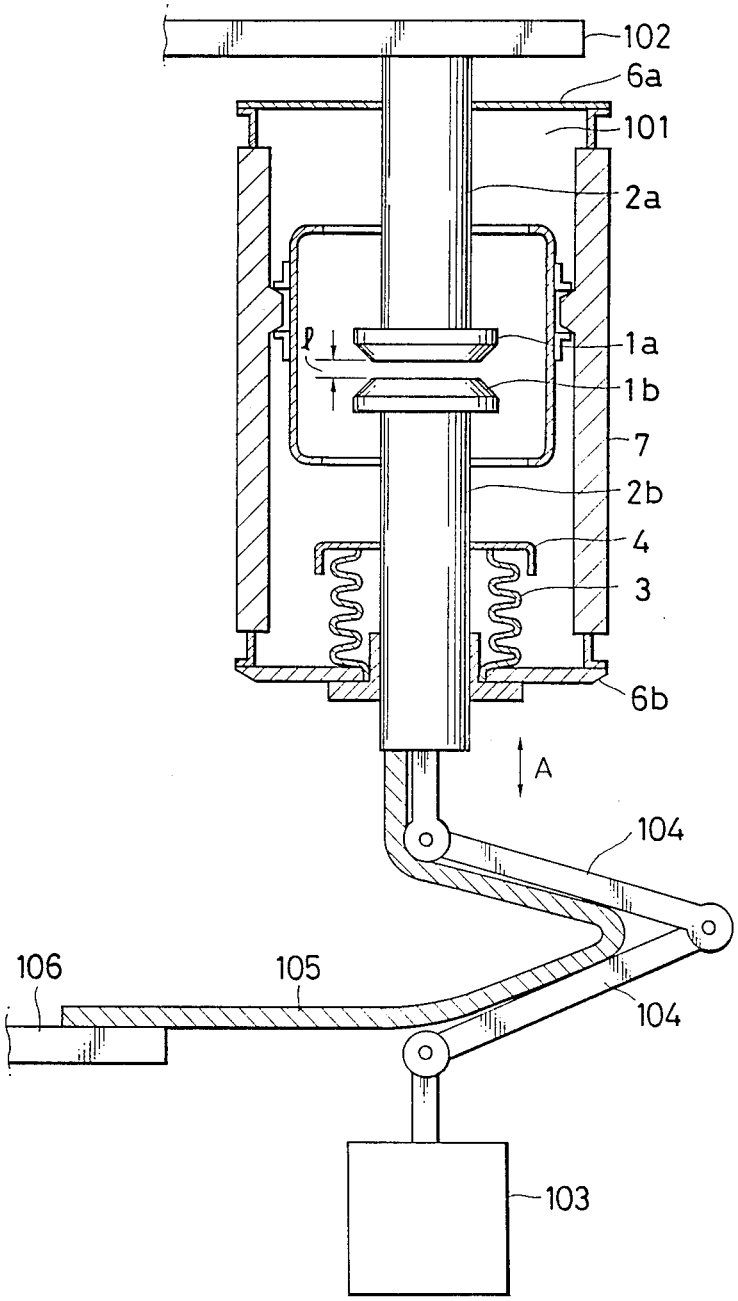
FIG. 11 PRIOR ART
FIG. 11 is a view in section showing the structure of a conventional vacuum breaker.
Figure 12A:
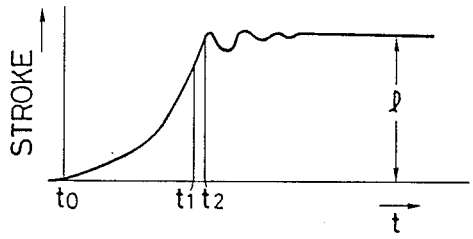
FIG. 12A PRIOR ART
FIG. 12A is a graph showing the stroke characteristics of the moving electrode of a conventional vacuum breaker.
Figure 12B:
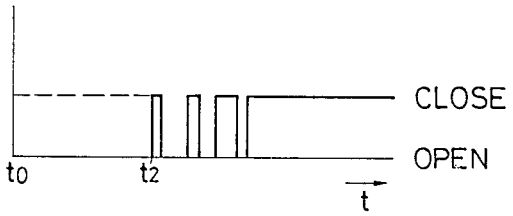
FIG. 12B PRIOR ART
FIG. 12B is a time chart showing the chattering of the moving electrode of a conventional vacuum breaker.
Figure 12C:
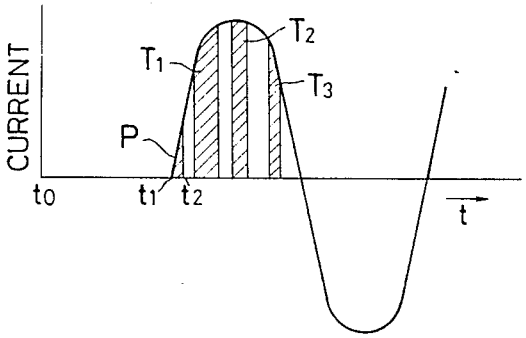
FIG. 12C PRIOR ART
FIG. 12C is a wavefrom diagram showing the fluctuations of current due to the chattering of a conventional vacuum breaker.

FIGS. 9 and 10 show the fifth embodiment of the invention. 31 is a coil electrode comprising center portion 31*a* fixed to contact electrode 12*a* (or 12*b*) through spacer 32, radial portion 31*b* extending in the radial direction, arc portion 31*c* extending in the direction of circumference, and connecting portion 31*d* connected to the contact electrode 12*a* (or 12*b*). Since spacer 32 is constructed of materials with an electrical conductivity less than 10% that of copper, current flows along a path formed of conductor 2*a* (2*b*), center portion 31*a*, radial portion 31*b*, arc portion 31*c*, connecting portion 31*d* and electrode 12*a* (12*b*). Magnetic field is produced in the vertical direction (direction of conductor 2*a* (2*b*)) by the current flowing through in arc portion 31*c*, resulting in improved breaking property.

In this embodiment, when spacer 32 is made of materials, and/or joined by the solders, with vibration absorbing property respectively, the same effect can be achieved as in the embodiments described previously.

What is claimed is:

1. A vacuum breaker comprising:

a switch tube maintained under vacuum, a first electrode arranged in said switch tube, a first conductor connected to said first electrode through a first joining means, a second electrode arranged in said switch tube such that it can come into contact with the first electrode and separate from it, and a second conductor connected to said second electrode through a second joining means, wherein at least part of one among the first and second electrodes, the first and second conductors, and the first and second joining means is made of material with vibration absorbing properties.

2. A vacuum breaker as in claim 1, wherein part of the first or second electrode, and the first or second joining means are made of said material respectively.

3. A vacuum breaker as in claim 2, wherein said joining means is solder comprising a copper alloy with a melting point of less than 1000° C.

4. A vacuum breaker as in claim 1, wherein said first or second conductor is installed in said switch tube via pieces made of said material.

5. A vacuum breaker as in claim 1, wherein said material has an electrical conductivity no less than 10% that of copper.

6. A vacuum breaker as in claim 5, wherein said material comprises a copper-containing alloy.

7. A vacuum breaker as in claim 5, wherein said material is of copper-manganese, copper-manganese-aluminum, copper-aluminum-nickel or nickel-titanium alloy.

8. A vacuum breaker as in claim 1, wherein said first and second electrodes are spiral electrodes having pieces made of said material on the circumference of back surface of said first and second electrodes.

9. A vacuum breaker as in claim 8, wherein said material have an electrical conductivity less than 10% that of copper.

10. A vacuum breaker as in claim 9, wherein said material are of an iron-containing alloy.

11. A vacuum breaker as in claim 9, wherein said material comprise iron-chromium-aluminum, iron-chrominum-molybdenum or iron-carbon-silicon alloy.

12. A vacuum breaker as in claim 1, wherein at least said first or second joining means is a spacer made of said materials and connecting said first or second electrodes and said first or second conductors at the center thereof, and said first or second electrodes has a coil electrode at the circumference thereof.

13. A vacuum breaker as in claim 1, wherein said material are magnetic materials which can exert a force of attraction between said first and second electrodes when a current flows in said electrodes.

14. A vacuum breaker as in claim 13, wherein the parts of the first and second electrodes which come into contact comprise copper, silver or aluminum.

15. A vacuum breaker as in claim 13, wherein said first and second electrodes have pieces made of said material in the form of an arc or a letter "C" so as to wrap around the centers of said first and second electrodes.

16. A vacuum breaker as in claim 13, wherein said material are of an iron-containing alloy.

17. A vacuum breaker as in claim 16, wherein said material are of iron-chromium, iron-aluminum, iron-chromium-molybdenum or iron-carbon-silicon alloy.

18. A vacuum breaker as in claim 13, wherein at least two pieces made of said material are attached to said first and second electrodes.

* * * * *